US005826500A

United States Patent [19]

Kemper

[11] Patent Number: 5,826,500

[45] Date of Patent: Oct. 27, 1998

[54] APPARATUS FOR TREATING OIL-BEARING MATERIAL

[75] Inventor: Timothy G. Kemper, Piqua, Ohio

[73] Assignee: The French Oil Mill Machinery Co., Ltd., Piqua, Ohio

[21] Appl. No.: 893,836

[22] Filed: Jul. 11, 1997

Related U.S. Application Data

[62] Division of Ser. No. 502,836, Jul. 14, 1995, Pat. No. 5,685,218.

[51] Int. Cl.[6] ..... B30B 9/14; B30B 11/24

[52] U.S. Cl. ..... 100/73; 99/483; 99/510; 99/516; 100/98 R; 100/127; 100/145; 100/337

[58] Field of Search ..... 100/70 R, 73, 100/98 R, 110, 117, 126, 127, 145, 147, 148, 337–340, 104; 99/483, 509, 510, 516

[56] References Cited

U.S. PATENT DOCUMENTS

| | | | |
|---|---|---|---|
| Re. 27,515 | 10/1972 | Bredeson . | |
| 778,969 | 1/1905 | Herron . | |
| 1,311,160 | 7/1919 | French . | |
| 1,327,093 | 1/1920 | French . | |
| 1,360,205 | 11/1920 | French . | |
| 1,387,700 | 8/1921 | French . | |
| 1,648,477 | 11/1927 | French . | |
| 1,765,626 | 6/1930 | Stacy . | |
| 2,004,408 | 6/1935 | Hiller . | |
| 2,072,141 | 3/1937 | Stacy . | |
| 2,072,488 | 3/1937 | Stacy . | |
| 2,122,202 | 6/1938 | French, Jr. . | |
| 2,149,736 | 3/1939 | Hiller et al. . | |
| 2,320,765 | 6/1943 | Upton . | |
| 2,335,819 | 11/1943 | Upton . | |
| 2,369,192 | 2/1945 | Upton . | |
| 2,902,923 | 9/1959 | Stacy . | |
| 2,997,943 | 8/1961 | Zies | 100/117 |

(List continued on next page.)

FOREIGN PATENT DOCUMENTS

| | | | |
|---|---|---|---|
| 1045233 | 11/1958 | Germany . | |
| 596614 | 3/1978 | Russian Federation . | |
| 1475806 | 4/1989 | Russian Federation . | |
| 186644 | 12/1963 | Sweden | 100/117 |

*Primary Examiner*—Stephen F. Gerrity
*Attorney, Agent, or Firm*—Biebel & French

[57] ABSTRACT

An apparatus and method for treating oil-bearing material which includes an extruder having an elongated enclosure with an inlet end. The extruder also includes a worm assembly for working and advancing the material through the enclosure from the inlet end to the discharge end. A high pressure region is located adjacent the extruder inlet end. A force feeder provides material to the high pressure region at a specified supply rate. Oil in the material is liberated and drained in the high pressure region to a specified level prior to entry of the material into the extruder inlet end. The apparatus also includes an outlet in the high pressure region for drainage of the released oil, as well as a screen over the outlet to prevent material greater than a specified size from exiting the high pressure region through the outlet. The seed material is mechanically worked via the action of a rotating screw in the extruder. At the same time, steam is injected into the extruder to condition the worked seed material. The extruder is devoid of any slots or the like which would permit further oil drainage in the extruder section. The material is worked and conditioned as it is transported through the extruder. It is forced through a die orifice to form conditioned, uniform pellets of reduced oil content.

12 Claims, 2 Drawing Sheets

U.S. PATENT DOCUMENTS

| | | | |
|---|---|---|---|
| 3,067,462 | 12/1962 | Kullgren . | |
| 3,067,672 | 12/1962 | French . | |
| 3,092,017 | 6/1963 | French et al. . | |
| 3,093,065 | 6/1963 | French . | |
| 3,111,080 | 11/1963 | French et al. . | |
| 3,246,597 | 4/1966 | Burner . | |
| 3,255,220 | 6/1966 | Baer et al. . | |
| 3,285,163 | 11/1966 | Burner . | |
| 3,366,039 | 1/1968 | French et al. . | |
| 3,385,709 | 5/1968 | Wenger et al. . | |
| 3,518,936 | 7/1970 | Bredeson . | |
| 3,561,351 | 2/1971 | French et al. . | |
| 3,574,891 | 4/1971 | Bredeson et al. . | |
| 3,592,128 | 7/1971 | French . | |
| 3,672,641 | 6/1972 | Slaby | 100/117 |
| 3,721,184 | 3/1973 | French et al. . | |
| 3,768,171 | 10/1973 | Bird et al. . | |
| 4,024,168 | 5/1977 | Homann et al. . | |
| 4,117,776 | 10/1978 | Hunt . | |
| 4,271,754 | 6/1981 | Homann . | |
| 4,361,081 | 11/1982 | Howard . | |
| 4,373,434 | 2/1983 | Alexander et al. . | |
| 4,401,023 | 8/1983 | Suhr et al. . | |
| 4,415,336 | 11/1983 | Stasi et al. | 100/145 |
| 4,646,631 | 3/1987 | Ward . | |
| 4,874,555 | 10/1989 | Upchurch . | |
| 4,901,635 | 2/1990 | Williams . | |
| 5,680,812 | 10/1997 | Linsgeseder | 100/148 |
| 5,685,218 | 11/1997 | Kemper | 100/73 |

10
12
14
16
18
20
22
24
26
27
28
29
30
32
34
36
38
40
42
44
50

APPARATUS FOR TREATING OIL-BEARING MATERIAL

This is a divisional of application Ser. No. 08/502,836 filed on Jul. 14, 1995 (now U.S. Pat. No. 5,685,218).

BACKGROUND OF THE INVENTION

1. Field of the Invention

The present invention relates to an apparatus and method for treating oil-bearing material prior to solvent extraction and, more particularly, to an apparatus and method including a pressure region adjacent the inlet end of an extruder to release oil from the material to a specified level prior to the material entering the extruder.

2. Description of Related Art

Traditional methods of recovering oil from oil-bearing materials containing high levels of oil or fat have involved screw pressing or screw pressing followed by solvent extraction.

Some oleaginous plant materials containing high levels of oil or fat, such as peanuts, sunflower, rapeseed, canola, and copra, are typically cracked and/or flaked, conditioned, and screw pressed to help rupture the cells containing the oil and to remove from the material a significant portion of the oil. The partially de-oiled residue is then sent directly to solvent extraction, or it is processed through an extruder first before going to solvent extraction to attain a more consistent, porous shape.

While extrusion has been very effective in improving solvent extractability of many oleaginous plant materials, some problems exist with material having an oil or fat level above about 30% by weight. For example, some of the oil is liberated within the extruder, interrupting the steady-state operation of the extruder by creating pockets of free oil randomly spaced within the matrix of solid residue. The pockets of free oil then exit the extruder at high velocity and interrupt the shape and flow of the partially de-oiled residue. Another problem with extruders currently used in the oilseed industry is related to the low bulk density of the flake material entering the extruder. Because of the shape of the flakes, a great deal of air is drawn into the extruder along with the solids. This is a handicap because the feed worm cannot feed enough solids to the compaction worms in order to utilize the full capacity of the extruder and the total applied horse power.

In order to overcome some of these problems, U.S. Pat. No. 4,901,635 to Williams discloses an apparatus and method in which an extruder includes a perforated or slotted section in the barrel wall immediately upstream from the discharge die plate. While this extruder allows material having a high oil content to be processed without having to first put it through a separate screw press, it has been found that draining oil near the outlet of the extruder does not work on oilseeds which do not have significant fiber content. Accordingly, this extruder does not function effectively on peanut, canola or rapeseed feedstocks. It is thought that the machine's inefficiencies are due to the performance of concurrent oil extraction and steam injection steps in the extruder. The result is the production of dissimilar output pellet shapes of varying oil content.

Another system for preparing vegetable oilseed meal for solvent extraction is disclosed in U.S. Pat. No. 4,646,631 to Ward. In this system, a machine combining screw press and extruder sections along a common shaft is provided. The barrel of this machine has perforations in an upstream section thereof so that oil may drain therefrom and is not perforated in the downstream section. In this way, the meal is treated in the expander section with moisture for the subsequent formation of pellets to be treated by solvent extraction thereafter. However, it is understood that this design has a number of inherent difficulties. For example, it is difficult to select a compromise rotational speed for the common shaft since extruder shafts commonly rotate four to six times faster than stand alone screw press shafts. Additionally, the machine has been described as suffering from the traditional criticisms associated with screw presses, namely, high wear, labor intensive and low capacity shortcomings.

It is accordingly an object of the invention to provide a versatile, efficient, and relatively inexpensive apparatus which can be used to remove oil and condition a variety of oil seeds including especially low fiber containing seeds such as canola, rapeseed and peanut seeds.

Yet another objective of the present invention is to provide an apparatus and method for treating oil-bearing material in which pressure requirements on the machine are reduced from traditional levels while still providing satisfactory oil removal so that machine construction material cost savings can be realized.

SUMMARY OF THE INVENTION

In accordance with one aspect of the present invention, an apparatus for treating oil-bearing material is disclosed which includes an extruder having an elongated enclosure with an inlet end and a discharge end, wherein the material enters the inlet end at a specified feed rate. The extruder also includes means for working and advancing the material through the enclosure from the inlet end to the discharge end.

A high pressure region (i.e. 500–2,000 psi) is located upstream from the extruder. A supply means conveys material to the high pressure region at a specified supply rate. Oil expressed from the material is drained from this high pressure region prior to the material's exit from the high pressure region and entry to the extruder inlet end.

The apparatus also includes an outlet in the high pressure region for drainage of the released oil, as well as a screen over the outlet to prevent material greater than a specified size from exiting the high pressure region through the outlet. The supply rate of the material to the high pressure region exceeds the volumetric flow rate of the material exiting the high pressure region, with the specified supply rate preferably being 3–7 times greater than the specified exit rate. The extruder preferably includes a pressure seal providing an interface between the exit end of the high pressure region and the inlet end of the extruder. Accordingly, pressure on the material in the extruder initially drops substantially from the pressure on the material in the high pressure region. In order to form pellets of the material, a restricted die plate orifice is provided at the extruder outlet end.

In accordance with a second aspect of the present invention, a method of treating oil-bearing material is disclosed in which the steps involve supplying the material to the high pressure region at a specified supply rate, draining oil from the material in the high pressure region, forwarding the material to an extruder at a specified feed rate and under reduced pressure conditions, and then extruding the material. This method also includes preferred steps of draining the released oil from the high pressure region, substantially reducing the pressure on the material upon entering the extruder, and forming pellets from the extruded material.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figures 1, 1A:
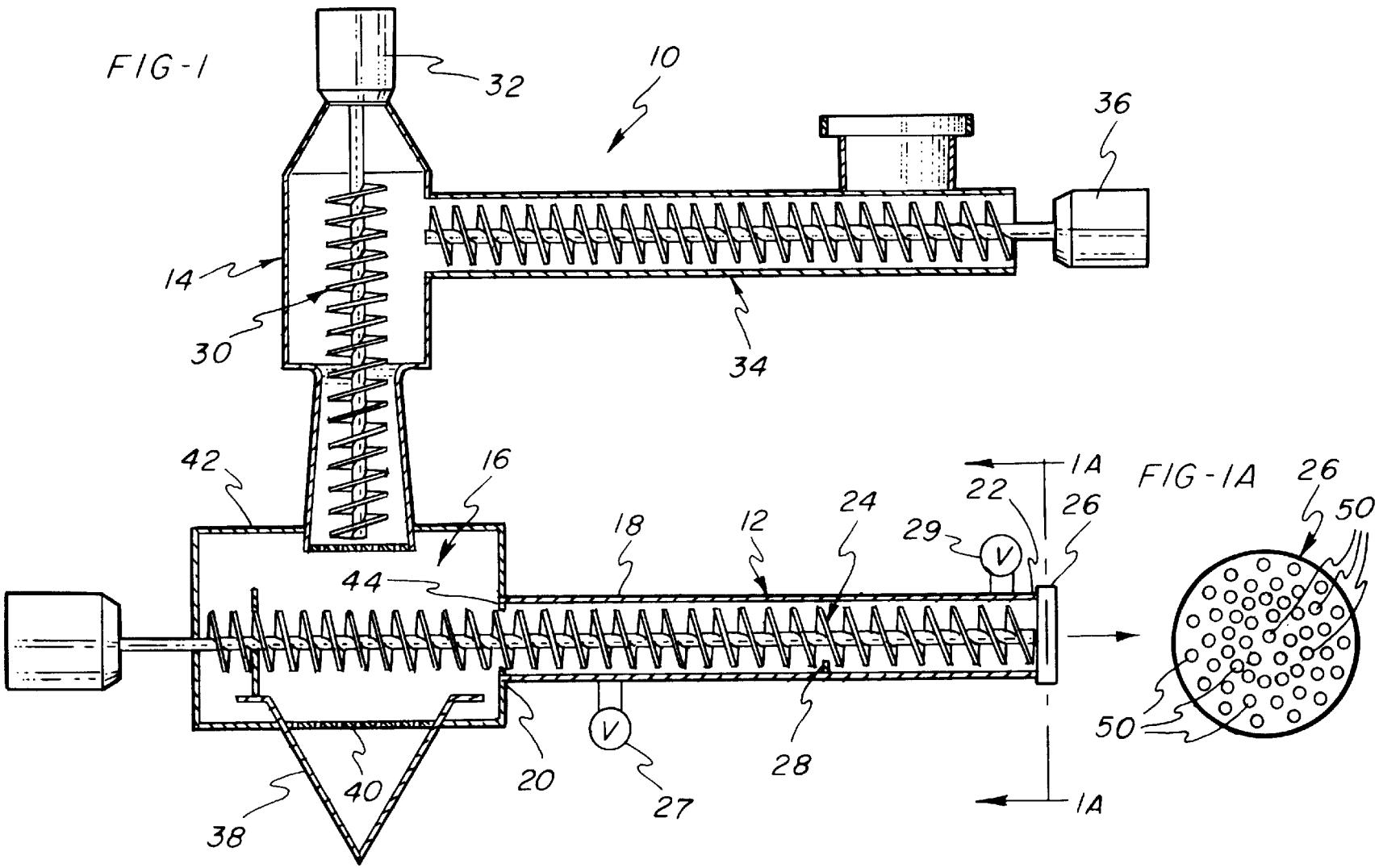
FIG. 1 is a diagrammatic depiction of the apparatus of the present invention.
FIG. 1*a* is a sectional view taken along the plane indicated by the line and arrows 1A—1A shown in FIG. 1.

Referring now to the drawing in detail, wherein identical numerals indicate the same elements throughout the figures, FIG. 1 depicts a system 10 which is utilized to treat oil-bearing material prior to solvent extraction. As seen therein, the system 10 is principally comprised of an extruder 12, a force feeder 14, and a high pressure region 16 formed therebetween.

Extruder 12 has an elongated enclosure or barrel 18 having an inlet end 20 and a discharge end 22. Means 24 are provided within extruder 12 for working and advancing material through barrel 18 from inlet end 20 to discharge end 22. As shown, means 24 comprises a wormshaft having a plurality of worm flights thereon. Barrel 18 does not include any perforations, slots or the like for the drainage of any oil extracted during the extrusion process. Therefore, the oil content of the material while in the extruder section of the device preferably remains substantially constant. It is considered important to the present invention that the oil content of the material during the extrusion process remain substantially constant.

Further, extruder 12 includes a restricted orifice at outlet end 22, preferably in the form of a die plate 26. It will also be seen that at least one steam injector 27, 28, 29 is provided along barrel 18 in order to inject steam into the extrusion process to aid in the mechanical working of the oleaginous material. Additionally, this moisture will "flash-off" and allow the material to form a porous pellet as the material exits through the die plate 26.

With respect to force feeder 14, it will be seen that it preferably is disposed substantially perpendicularly with respect to barrel 18 of extruder 12 and optimally is oriented vertically as seen in FIG. 1. This vertical orientation provides an advantageous arrangement with respect to the draining of oil from high pressure region 16, as described below. Preferably, force feeder 14 contains a screw mechanism 30 with an associated drive mechanism 32 to force oil-bearing material into high pressure region 16 at a specified supply rate. The screw flights associated with the screw 30 compress, and shear the material to mechanically work same to thereby liberate oil. A variable speed feed conveyor 34 is preferably utilized to supply oil-bearing seeds into force feeder 14 and is operated by a separate drive mechanism 36.

While in high pressure region 16, oil from the oil-bearing material is released and drains through an outlet 38. A screen 40 or other similar device is positioned over outlet 38 in order to prevent material greater than a specified size from exiting high pressure region 16 through outlet 38. In this manner, the oil content of the material is reduced to a specified level prior to entering extruder 12.

High pressure region 16 is housed by chamber 42 which has a diameter greater than extruder barrel 18. In the preferred embodiment shown, the high pressure in region 16 is formed by the difference in the volumetric feed and exit speeds of the oil seed material to and from chamber 42. Of course, the skilled artisan can fashion other ways in which such a high pressure region can be formed. For example, pressurized air could be fed to chamber 42 or the screw 30 could be provided with increasingly larger worm flights proceeding from the upstream to the downstream direction. Also, the walls of the force feeder 14 could be constructed so as to converge as the material is transported downstream along the screw 30. The important aspect is that the pressure should be controlled within the region 16 so that it is on the order of between about 500–2,000 psi, preferably about 1,000 psi.

Preferably, in the embodiment shown, the specified supply rate of material to region 16 is 3–7 times greater than the specified exit rate. This is accomplished by driving screw mechanism 30 at a rotational speed about 3–7 times greater than the rotational speed of the wormshaft in extruder 12.

In order to aid in control of the pressure within high pressure region 16, a pressure seal 44 is preferably provided at extruder inlet end 20. Pressure seal 44 is preferably in the form of a collar built in the chamber 42 along the interfacial area between the high pressure region and inlet end 20 of the extruder 12.

Pressure is controlled within the barrel 18 so that it increases as the oil seed material is worked along the barrel from an upstream to downstream location. At the inlet end 20 of the extruder 12, the internal pressure (i.e. pressure within barrel 18) may range from about ambient to about 50 psi. Pressure within the barrel increases so that at the outlet end 22 of the extruder, pressure may range, for example, from about 400–600 psi, preferably 500 psi.

Pressure within the barrel 18 may be regulated by the rotational speed and depth of the flights of the screw 24 and via back pressure from die plate 26. As is conventional in the art, the screw 24 serves to provide compression and shear to mechanically work the oil seed material as it is transported through the conveyor. The artisan will envision other conventional means for regulating this pressure.

Turning to FIG. 1A, die plate 26 comprises a plurality of apertures 50 to provide exit for the mechanically worked and conditioned oil seed material at the outlet end 22 of barrel 18. As is conventional in the art, the number of apertures can be varied by provision of slugs or blanks in certain of the apertures, or collars or the like may be placed adjacent the die plate to vary the diameter of the aperture openings. All of these modifications result in the regulation of the back pressure within the barrel 18.

Figure 2B:
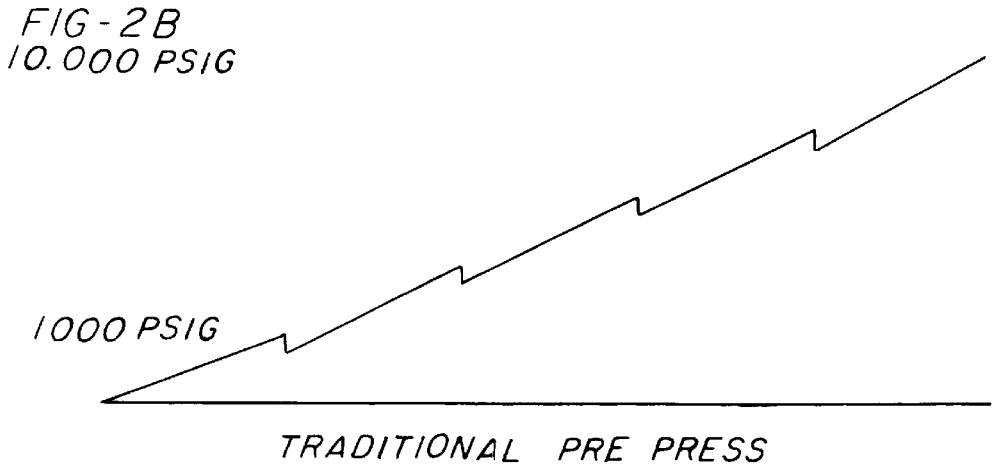
FIG. 2*b* is a graph representative of the pressure requirements of a traditional prior art prepress.
Figure 2A:
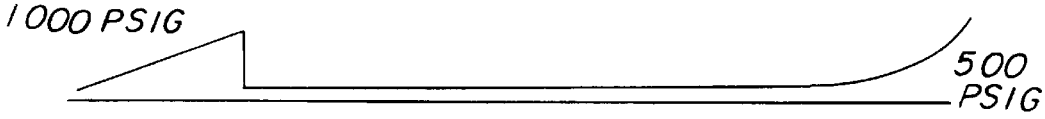
FIG. 2*a* is a graph representative of the pressure requirements of the apparatus of FIG. 1.

In order to better understand the mechanical requirements of system 10, a graphical representation of the pressures in the high pressure region 16 and extruder 12 are depicted in FIG. 2*a*. Preferably, the pressure within high pressure region 16 increases gradually to a maximum pressure of about 1,000 psi within the chamber 42 just upstream from the seal 44. During this time, drainage of oil through outlet 38 occurs until the specified level of oil for the material is reached. Thereafter, a pressure drop occurs as the material is advanced through the seal area into the inlet end 20 of extruder 12. Then, during the extrusion process of working and advancing the material from inlet end 20 to outlet end 22, the pressure within extruder 12 slowly increases to a maximum of approximately 500 psi at the outlet end 22 of barrel 18.

Figure 2C:
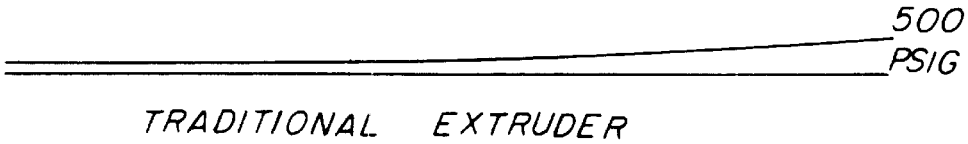
FIG. 2*c* is a graph representative of the pressure requirements of a traditional prior art extruder.

FIG. 2*b* illustrates the pressure conditions experienced within a traditional prior art prepress. These traditional "prepresses" included an upstream screw press in combination with an extruder located downstream from the screw press. Here pressures of up to approximately 10,000 psi were provided along the length of the device. Moreover, oil drainage was provided along the entire length of the extruder barrel in these devices. FIG. 2*c* depicts the pressure conditions normally utilized in a traditional extruder. Here, pressure would slowly rise along the extruder length resulting in a maximum pressure of approximately 500 psi at the downstream, exit end of the extruder.

In contrast to the pressure conditions schematically shown in FIGS. 2B and 2C for certain of prior art devices, FIG. 2A is a schematic representation of pressure condition parameters used in accordance with the invention. Here, in FIG. 2A, pressure along the force feeder 14 and associated screw 30 slowly increase to a peak of between about 500–2,000 psi, preferably 1,000 psi, at a location just upstream from seal 44 within the high pressure region. Immediately downstream from seal 44, pressure drops to between about ambient −50 psi. Then, pressure along extruder 12 rises slowly to a maximum of about 400–600, preferably 500 psi, at outlet end 22 of the extruder.

In operation, and with respect to FIG. 1 of the drawings, the desired oleaginous material is fed to the feed hopper in communication with feed conveyor 34. Feed conveyor 34 forwards the material to force feeder screw 30. As the material is worked along screw 30 into high pressure region 16, oil is released in the high pressure region 16 with concurrent oil drainage through outlet 38 and associated screen mechanism 40. Preferably, the oil content of the seed material is reduced in the high pressure region from in excess of 30% to about 25–30 wt %.

The material subsequently is forced through seal area 44 into the extruder 18. Steam may be admitted through one of the valves 27, 28, 29 and flows cocurrently with the material flow direction along the extruder. Due to the gradually increasing pressure exerted on the material in the extruder barrel 18, as it is mechanically worked from the inlet end 20 toward the outlet end 22, the meal is conditioned. The meal then passes through the apertures 50 provided in die plate 26, with the moisture flashing off to facilitate the production of porous pellets which are then ready for the subsequent extraction process.

In accordance with the preferred process, the oil content of the material exiting die plate 26 is on the order of about 25–30 wt %. It should be noted that no oil drainage is provided along the length of barrel 18. Accordingly, as the material is transported along barrel 18 by screw 24, it is worked and conditioned by the steam treatment and rotating screw flights without any oil drainage.

It will be understood that system 10 of the present invention is particularly useful for oilseeds having a high content of oil (e.g.,more than 30% oil by weight). This group of oilseeds includes peanuts, sunflower, rapeseed, canola, and copra. When supplied to pressure region 16, such high content oilseeds are preferably reduced in oil content to between 25–35% oil by weight.

Having shown and described the preferred embodiment of the present invention, further adaptations of system 10 and the method of treating oil-bearing material thereby can be accomplished by appropriate modifications by one of ordinary skill in the art without departing from the scope of the invention.

What is claimed is:

1. An apparatus for conditioning oil bearing material from an upstream entry end to a downstream discharge end of said apparatus, comprising:

(a) chamber means located at said upstream end defining a high pressure region for maintaining a pressure of about 500–2,000 psi therein;

(b) an extruder located downstream from said chamber means said extruder comprising transport means (c) for transporting said oil bearing material from said high pressure region to said downstream discharge end of said apparatus.

2. Apparatus as recited in claim 1 further comprising (d) means for feeding said oil bearing material to said chamber means and for transporting said material through said high pressure region to an inlet for said extruder.

3. Apparatus as recited in claim 2 wherein said transport means (c) comprises a screw means for mechanically compressing and shearing said material as it is transported through said extruder.

4. Apparatus as recited in claim 2 wherein said feed means (d) is vertically inclined and disposed at substantially a right angle to said transport means (c).

5. Apparatus as recited in claim 1 wherein said high pressure region comprises (e) means for draining oil from said oil bearing material.

6. Apparatus as recited in claim 1 wherein said extruder comprises a (f) die plate having a plurality of apertures formed therein located at said discharge end of said apparatus.

7. Apparatus as recited in claim 1 wherein said extruder comprises (g) steam inlet means for injecting steam into said extruder.

8. Apparatus as recited in claim 7 wherein said extruder is devoid of any means for draining oil.

9. An apparatus for conditioning oil bearing material from an upstream entry end to a downstream discharge end of said apparatus, comprising:

(a) chamber means located at said upstream entry end defining a high pressure region adapted to maintain a pressure of about 500–2,000 psi therein;

(b) an extruder located downstream from said chamber means, said extruder comprising transport means (c) for transporting said oil bearing material from said high pressure region to said downstream discharge end of said apparatus; and (d) feed means for feeding said oil bearing material to said chamber means and for transporting said material through said high pressure region to an inlet for said extruder, said feed means being adapted to feed said material to said chamber means at a volumetric flow rate that is about 3–7 times greater than the volumetric flow rate of material transported by said transport means (c).

10. An apparatus for conditioning oil bearing material from an upstream entry end to a downstream discharge end of said apparatus, comprising:

(a) chamber means located at said upstream entry end defining a high pressure region adapted to maintain a pressure of about 500–2,000 psi therein;

(b) an extruder located downstream from said chamber means, said extruder comprising transport means (c) for transporting said oil bearing material from said high pressure region to said downstream discharge end of said apparatus;

(d) feed means for feeding said oil bearing material to said chamber means and for transporting said material through said high pressure region to an inlet for said extruder; and (h) said chamber means comprising a pressure seal means disposed therein for providing a pressure seal between said chamber and said extruder.

11. Apparatus as recited in claim 10 wherein said pressure seal means is disposed adjacent to said extruder inlet, whereby a pressure drop region is formed immediately downstream of said pressure seal means in said extruder wherein pressure in said pressure drop region is from about ambient to about 50 psi.

12. An apparatus for conditioning oil bearing material from an upstream entry end to a downstream discharge end of said apparatus, comprising:

(a) chamber means located at said upstream entry end defining a high pressure region adapted to maintain a pressure of about 500–2,000 psi therein;

(b) an extruder located downstream from said chamber means, said extruder comprising transport means (c) for transporting said oil bearing material from said high pressure region to said downstream discharge end of said apparatus;

(d) a force feeder for feeding said oil bearing material to said chamber means, said force feeder being vertically inclined and disposed at substantially a right angle to said extruder (b).

* * * * *